US005659897A

United States Patent [19]

Satoh et al.

[11] Patent Number: 5,659,897

[45] Date of Patent: Aug. 26, 1997

[54] BASEBALL GLOVE WITH THUMB MEMBER

[75] Inventors: Kazunori Satoh; Fumiaki Kobayashi, both of Osaka, Japan

[73] Assignee: Zett Kabushiki Kaisha, Osaka-fu, Japan

[21] Appl. No.: 644,613

[22] Filed: May 1, 1996

[30] Foreign Application Priority Data

Oct. 4, 1995 [JP] Japan ..... 7-257355

[51] Int. Cl.[6] ..... A41D 13/10

[52] U.S. Cl. ..... 2/19; 2/16

[58] Field of Search ..... 2/16, 17, 19, 20, 2/21, 161.1, 163, 169

[56] References Cited

U.S. PATENT DOCUMENTS 1,064,859 6/1913 Sargent ..... 2/19
1,087,292 2/1914 Hooper ..... 2/19
1,202,705 10/1916 Goldsmith ..... 2/19
1,562,176 11/1925 Latina ..... 2/19
2,434,171 1/1948 Latina ..... 2/19
3,898,696 8/1975 Campanis ..... 2/19

*Primary Examiner*—C. D. Crowder
*Assistant Examiner*—Larry D. Worrell, Jr.
*Attorney, Agent, or Firm*—Townsend and Townsend and Crew LLP

[57] ABSTRACT

A ball catching apparatus has a a thumb inserting portion and first and second cover members provided on a non-ball-catching side of the apparatus for forming the thumb inserting portion. The first cover member includes an extension portion extending along a direction of inserting the thumb. The second cover member is provided at least around the extension portion. The thumb inserting portion is formed by connecting the first and second cover members to each other at the extension portion, with the first cover member covering at least a portion of the second cover member.

9 Claims, 5 Drawing Sheets

BASEBALL GLOVE WITH THUMB MEMBER

BACKGROUND OF THE INVENTION

1. Field of the Invention

The present invention relates to a ball catching apparatus having first and second cover members which are provided on a non-ball-catching side of the apparatus for forming a thumb inserting portion.

2. Description of the Related Art

A conventional baseball glove (to be briefly referred to as 'glove' hereinafter), as an example of a ball catching apparatus of the above-noted type, has a construction as shown in FIGS. 6 and 7. In FIG. 6, a thumb inserting portion H surrounded with an alternate long and short dash line in the figure is formed by a left cover 40 and a right cover 41 as viewed from the non-ball-catching side of the glove. These covers 40, 41 are sewn to each other via a string member 42 by means of an unillustrated thread. FIG. 7 is a section taken along a line A—A in FIG. 6. As shown in this figure, the covers 40, 41 respectively include, at the mutually sewn portions thereof, projections 40*a*, 41*a* projecting into the thumb inserting portion H for facilitating the sewing operation.

On the other hand, inside the thumb inserting portion H, there is provided a thumb hook member 3 to which a user's thumb is to be hooked. The thumb hook member 3 includes a connected portion 3*a*, a knot portion 3*b* and a loop portion 3*c*. And, the thumb is hooked to the loop portion 3*c*. The connected portion 3*a* is fixedly connected to an inner ply 5. This inner ply 5 and an outer play 4 are provided on the ball-catching side of the glove. A cushioning felt 6 is interposed between the outer ply 4 and the inner play 5, the outer and inner plies 4, 5 are connected to each other by means of an unillustrated thread. In these manners, the thumb inserting portion H of the glove is constructed.

However, the conventional construction of the thumb inserting portion H has a problem to be described next.

As shown in FIG. 7, the projections 40*a*, 41*a* of the covers 40, 41 tends to hinder the thumb inserting operation and also to press the inserted thumb uncomfortably.

For solving the above problem, it is conceivable to bulge the portion of the thumb inserting portion H in which the thumb F is to be inserted and accommodated, as indicated by a dot line I in FIG. 7. In this case, the side edges (i.e. the sewn portions) of the covers 40, 41 need to be bulged. With such bulging arrangement, however, since the side edges present curved shapes, a length L0 of the side edge of the cover 40 becomes shorter, while a length L2 of the side edge of the other cover 41 becomes longer. Accordingly, the sewing operation of these covers 40, 41 becomes difficult.

Further, the thumb hook member 3 is movable in the direction toward the little finger side of the glove (the direction denoted with a mark E in FIG. 7). Thus, the thumb F inserted into this thumb hook member 3 tends to be dislocated from the core of the felt 6 (the width-wise center of the felt), thereby to make it difficult for the force of the thumb to be transmitted via the felt 6 core to the ball-catching side of the glove. This makes a ball catching action difficult.

SUMMARY OF THE INVENTION

In view of the above-described state of the art, a primary object of the present invention is to provide an improved ball catching apparatus which allows a smooth an unobstructed insertion of the thumb and which does not give the uncomfortable pressing feel to the inserted thumb.

A further object of the present invention is to provide a ball catching apparatus which may facilitate the sewing operations of the thumb inserting portion.

A still further object of the present invention is to provide a ball catching apparatus which facilitates the ball catching action.

For fulfilling the above-noted object, a ball catching apparatus, according to the present invention, comprises:

a thumb inserting portion;

a first cover member provided on a non-ball-catching side of the apparatus for forming the thumb inserting portion, the first cover member including an extension portion extending along a direction of inserting the thumb;

a second cover member provided on the non-ball-catching side of the apparatus for forming the thumb inserting portion, the second cover member is provided at least around the extension portion;

wherein, said thumb inserting portion is formed by connecting the first and second cover members to each other at the extension portion, with the first cover member covering at least a portion of the second cover member.

With the above-described construction, the first cover member includes the extension portion extending along the direction of insertion of the thumb into the apparatus, and the inserted thumb is covered at this extension portion. Further, this first cover member is devoid of such projections as described in foregoing description of the prior art. Therefore, this apparatus allows smooth insertion of the thumb and does not give the unpleasant pressing feel to the inserted thumb. Hence, this apparatus is convenient and comfortable to use.

Also, as the first cover member and the second cover member are connected to each other with the former covering at least a portion of the latter, the sewing operation of the thumb inserting portion may be carried out easily.

Preferably, connected portions of the first cover member and the second cover member are provided along an outer periphery of the extension portion.

If the connected portions of the cover members are provided along the outer periphery of the extension portion, the sewing operation of the thumb inserting portion may be further facilitated.

Preferably, the connection between the cover members is effected by means of a lace.

The connecting using a lace may assure sufficient connection strength between the first cover member and the second cover member. Further, the size of the space for introducing the thumb may be freely varied.

According to a further aspect of the invention, the apparatus further comprises: a thumb hook member provided inside the thumb inserting portion and a restricting portion for restricting dislocation of the thumb hook member toward the little finger side of the apparatus.

With the above, it becomes possible to prevent the thumb inserted into the thumb hook member from being dislocated from the core of cushioning felt. Accordingly, the force of the thumb may be efficiently transmitted via the felt core to the ball-catching side of the apparatus, whereby a ball catching action may be facilitated.

According to a still further aspect of the invention, the second cover member defines a cutout extending along the inserting direction of the thumb, and the restricting portion is constructed from an end face of the cutout.

With the above, since the restricting portion is provided in the second cover member, there is no necessity of providing any special member for forming the restricting portion.

As a result, the above-described essential features may be provided to the apparatus without complicating the construction of the apparatus.

According to a still further aspect of the invention, the apparatus further comprises a hand inserting opening and a belt portion for forming the hand inserting opening, and the belt portion is formed integral with the first cover member.

With the above features, the total number of components of the apparatus may be reduced, in comparison with a construction in which the belt portion and the first cover member are provided as two separate components.

As a result, the construction of the apparatus may be simple.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of the present invention will now be described in details with reference to the accompanying drawings.

Figure 1:
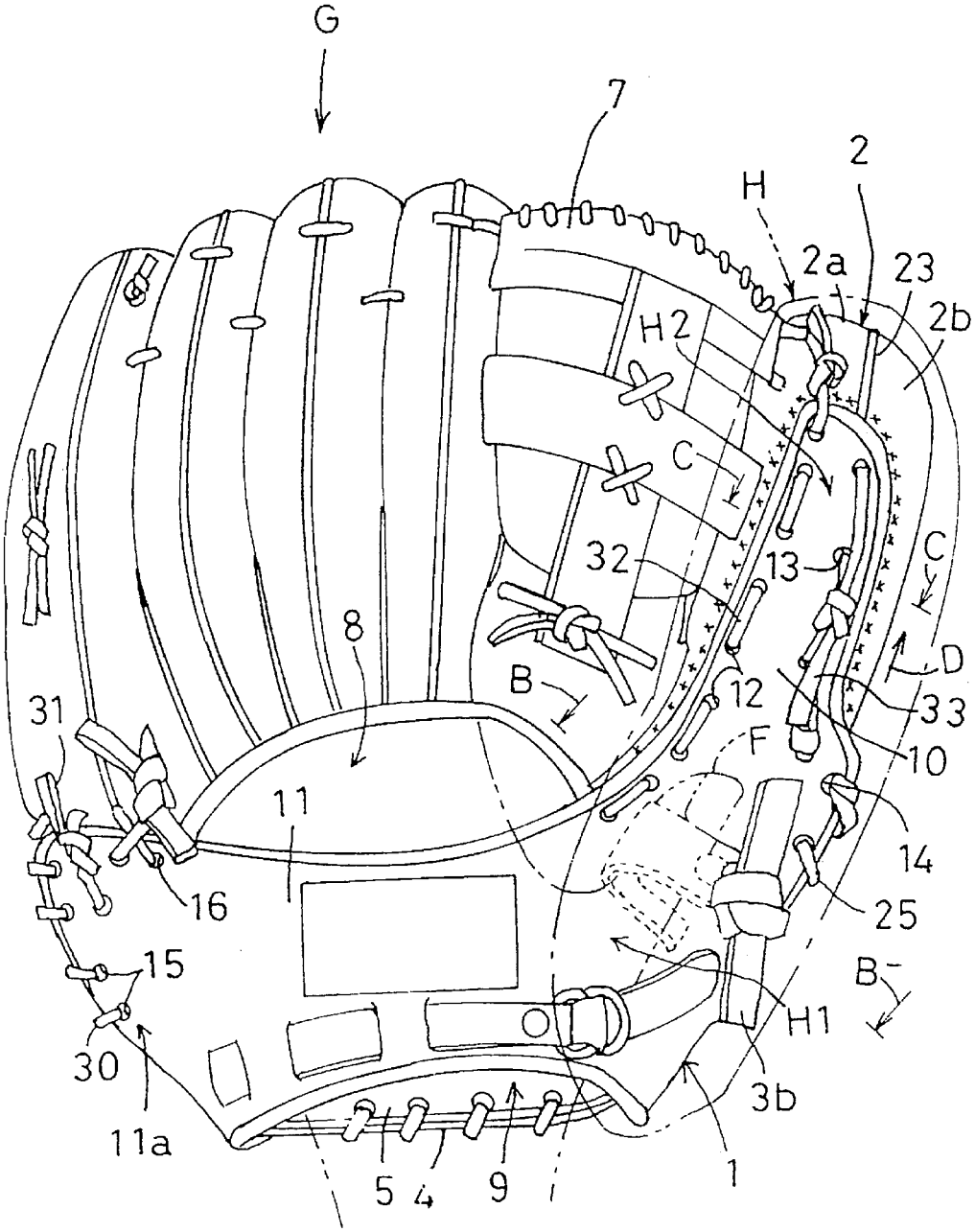
FIG. 1 shows an appearance of a baseball glove relating to the present invention as viewed from a non-ball-catching side thereof.
Figure 5:
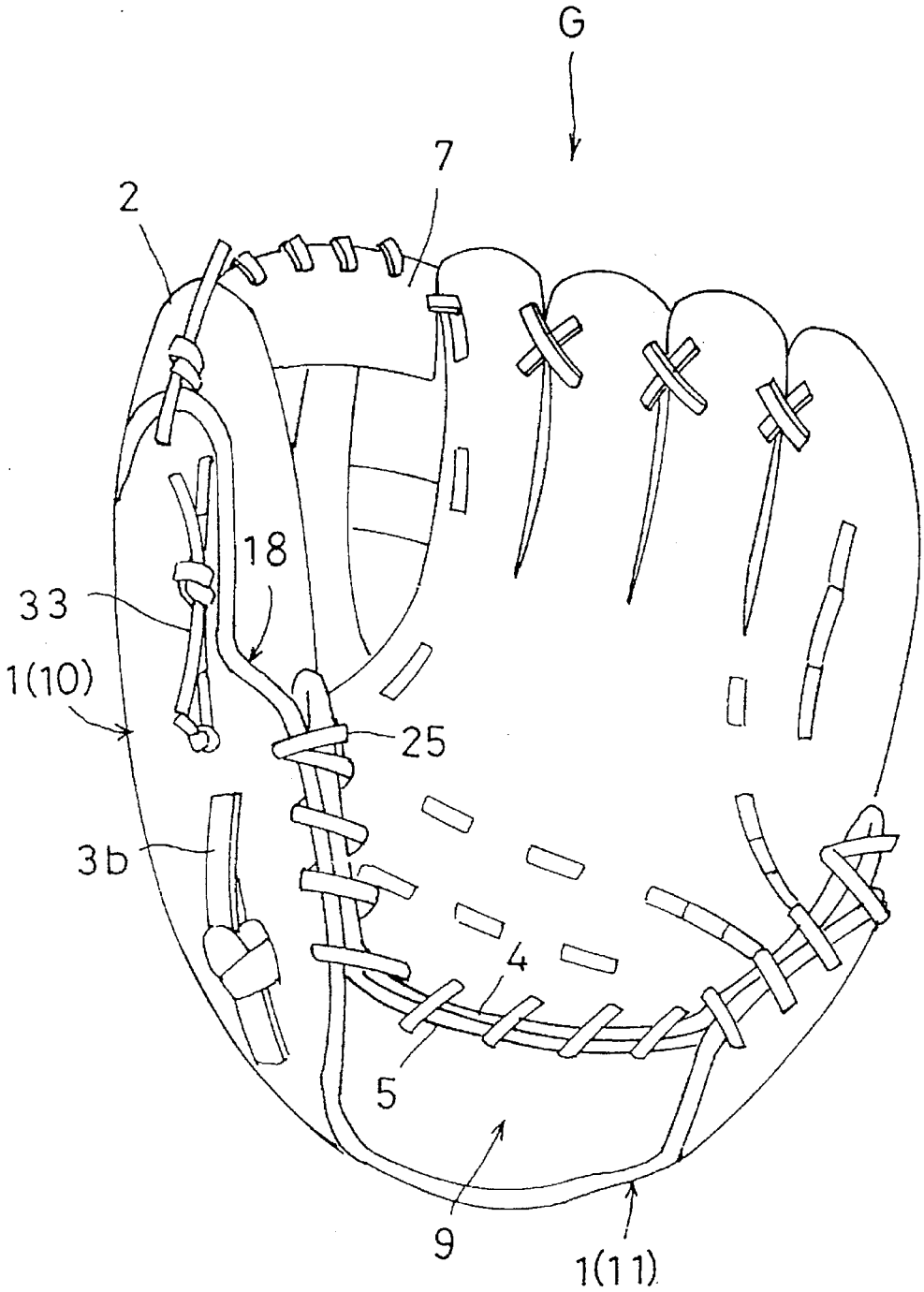
FIG. 5 shows an appearance of the baseball glove as viewed from the ball-catching side thereof.
Figure 6:
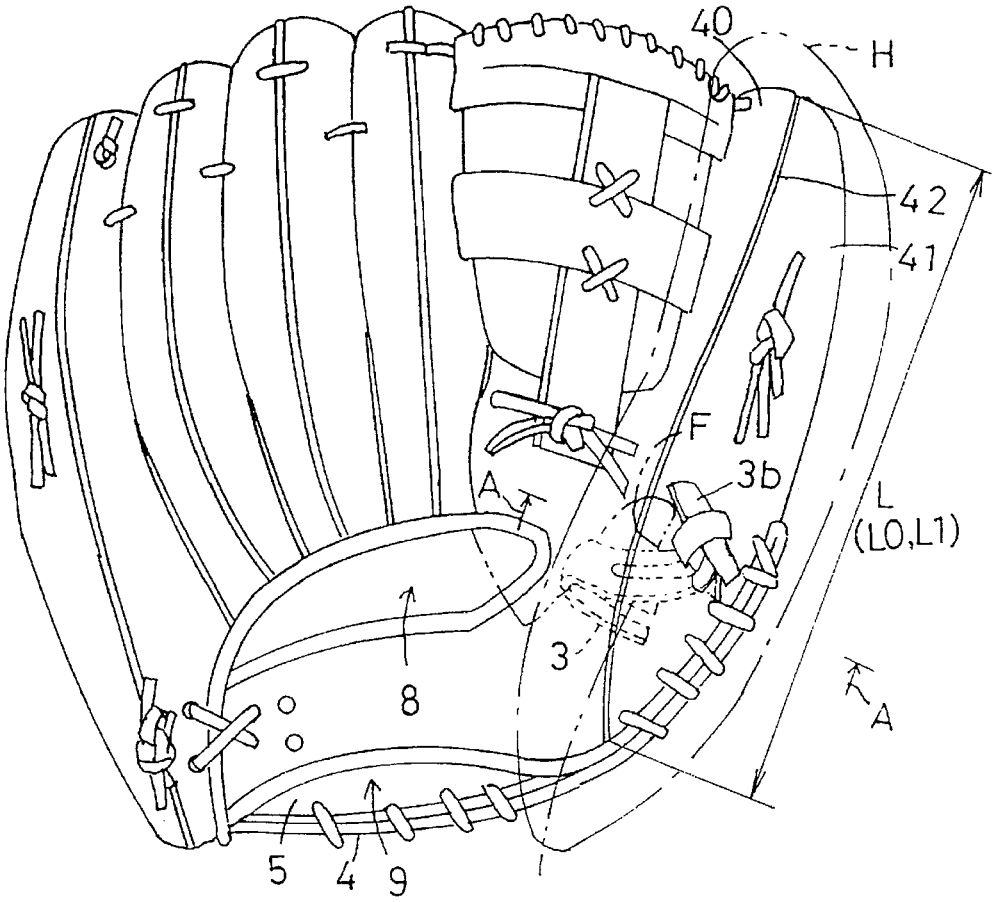
FIG.6 (Prior Art)
FIG. 6 shows an appearance of a conventional glove as viewed from the non-ball-catching side thereof.
Figure 7:
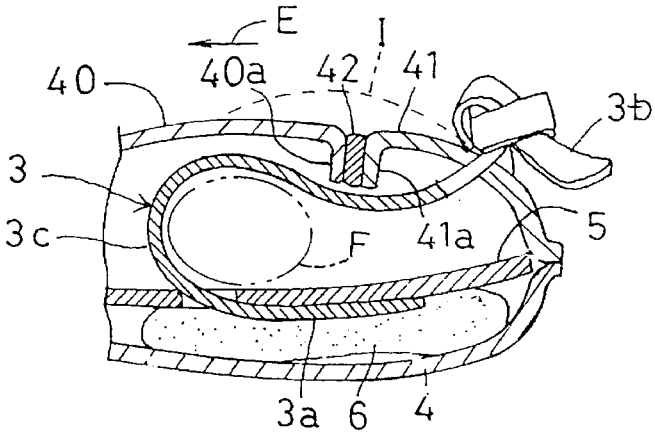
FIG 7 (Prior Art)
FIG. 7 is a section view taken along a line A—A in FIG. 6.

FIG. 1 shows an appearance of a glove G as viewed from a non-ball-catching side thereof. On this side, there are provided a first cover member 1 and a second cover member 2 for forming a thumb inserting portion H, which portion is denoted by an alternate long and short dashed line in FIG. 1. FIG. 5 shows an appearance of this glove as viewed from the opposite side, i.e. ball-catching side thereof. On this side, there are provided an outer ply 4 and an inner ply 5 for forming a ball-catching palm portion of the glove. These outer and inner plies 4, 5 are connected to each other by means of a lace. Further, adjacent the thumb inserting portion H, there is provided a backstop 7. There are also provided a hand inserting opening 9 and a belt portion 11 disposed adjacent the opening 9 for protecting the back side of the user's hand as inserted into the glove. The belt portion 11 is formed integral with the first cover member 1. Though this belt portion 11 may be provided separately from the first cover member 1, the integral formation of these components is advantageous for reducing the number of components of the glove. Referring back to FIG. 1, a cutout 8 is provided between the belt portion 11 and entrance openings of respective finger compartments of the glove. Inside the thumb inserting portion H, there is provided a thumb hook portion 3 to which the thumb is to be hooked.

Figure 4:
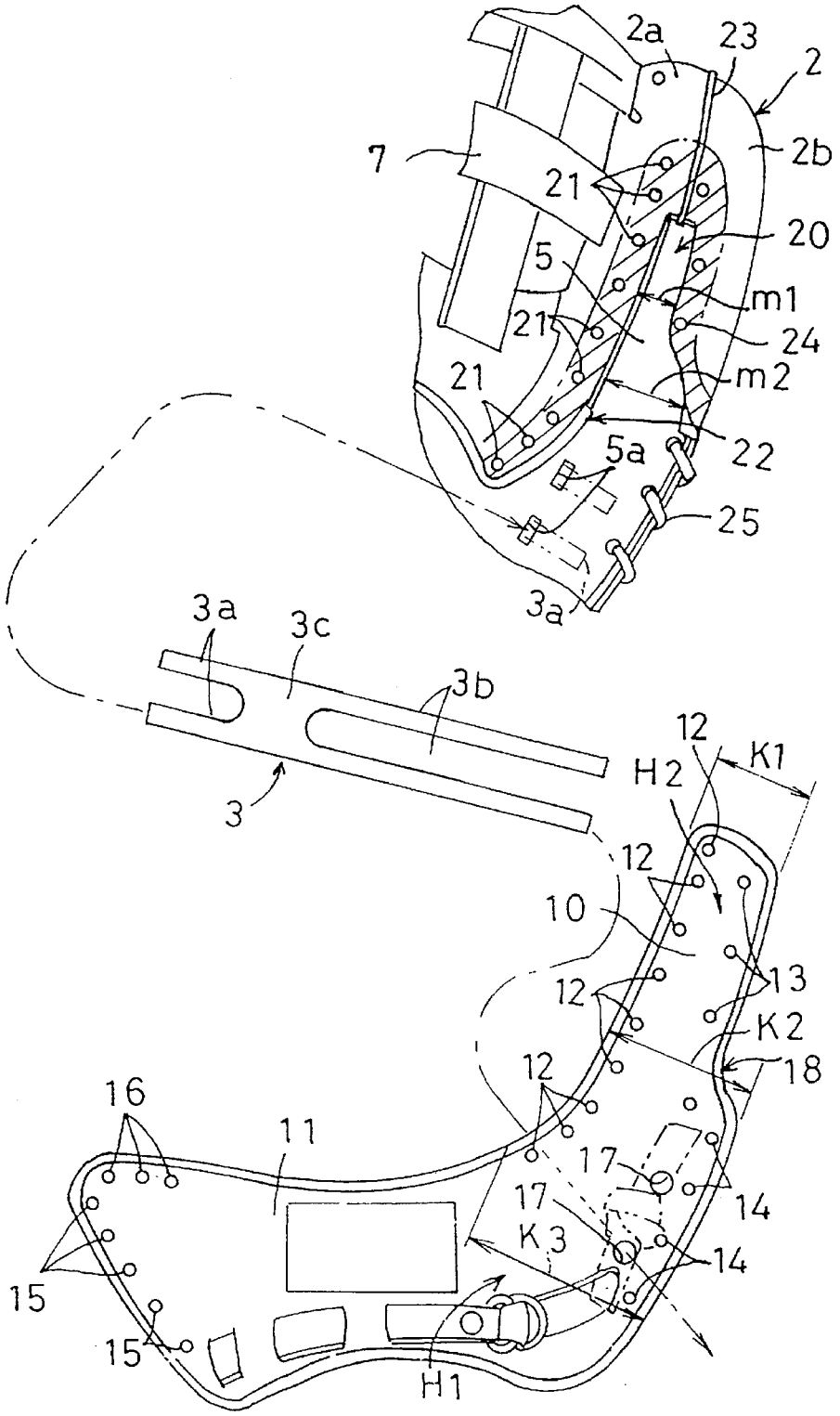
FIG. 4 shows, in details, constructions of a first cover member and a second cover member.

Next, the constructions of the first and second cover members 1, 2 will be described in details with reference mainly to FIG. 4.

The first cover member 1 is formed large enough to sufficiently cover the entire thumb F. Further, as the first cover member 1 has such size as described above, this cover member 1 may be readily shaped into a bulged form as indicated by a dot line I in FIG. 2, The first cover member 1 includes an extension portion 10 extending along the inserting direction of the thumb (the direction denoted with an arrow D in FIG. 1). More particularly, this extension portion 10 extends from a base end H1 of the thumb inserting portion H to a top end H2 of the same. Along the outer periphery of the extension portion 10, there are provided a plurality of holes 12, 13, 14. The holes 12, 13 are used for the connection between the first cover member 1 and the second cover member 2. The other hole 14 is used for the connection between the first cover member 1 and the outer ply 4 on the ball-catching side by means of a lace 25.

The second cover member 2 is provided to at least the peripheral portion (indicated by XX mark in FIG. 1) of the extension portion 10 of the first cover member 1. This peripheral portion is visible from the outside when the first and second cover members 1, 2 are connected and assembled to each other. The second cover member 2 includes a left cover **2*a* and a right cover 2*b*. And, these covers 2*a*, 2*b* are sewn to each other via a string member 23 by means of an unillustrated thread. This second cover member 2 defines a cutout 20 for forming a space into which the thumb F is inserted. Further, along the contour of this cutout 20, a plurality of holes 21, 24 are defined in the second cover member 2. These holes 21, 24 are used for the connection between the first cover member 1 and the second cover member 2. Specifically, the first and second cover members 1 and 2 are connected to each other by threading a lace 32 into the holes 21 of the second cover member 2 and the holes 12 of the first cover member 1 and also by threading a lace 33 into the holes 24 of the second cover member 2 and the holes 14 of the first cover member 1**.

Incidentally, when the first cover member 1 and the second cover member 2 are connected in the above-described manner, this connection is made such that the first cover member 1 covers at least a portion of the second cover member 2. In FIG. 4, this portion of the second cover member 2 covered with the first cover member 1 is indicated by a shading.

Further, the contour of the extension portion 10 of the first cover member 1 corresponds substantially to the contour of the second cover member 2. However, the extension portion 10 is slightly smaller in area than the second cover member 2.

A width K1 of the extension portion 10 at the top end H2 of the thumb inserting portion H is shorter than a width K3 of at the base end H1 of the thumb inserting portion H. Further, a stepped portion 18 is provided between the top end H2 and the base end H1. A width K2 in the vicinity of the stepped portion 18 is slightly shorter than the width K3 at the base end H1.

The cutout 20 of the second cover member 2 has a contour substantially corresponding to the contour of the extension portion 10. The width of this cutout 20 increases from the top end H2 to the base end H1. That is, a width m1 at the top end of the cutout 20 is shorter than a width m2 at an intermediate position between the top end to the base end of the cutout 20.

At the cutout 20, there is provided a thumb hook portion 3 to which the thumb F is to be hooked. This thumb hook portion 3 is shown in a developed state in FIG. 4 and shown in an assembled state in FIG. 2, respectively. The thumb hook portion 3 includes connected portions 3*a*, 3*a*, knot portions 3*b*, 3*b* and a loop portion 3*c*. The connected portions 3*a*, 3*a* are inserted into the holes 5*a*, 5*a* defined in the inner ply 5 to be fixed to this inner ply 5. The knot portions 3*b*, 3*b* are inserted into the holes 17, 17 defined in the first cover member 1 to be knotted together on the outside of the first cover member 1. A leading end of the loop portion 3*c* is brought into contact with an end face 22 of the second cover member 2. Further, as the first cover member 1 and the second cover member 2 are firmly connected to each other by the lace, the end face 22 is hardly movable, thereby to restrict dislocation of the thumb hook member 3 toward the little finger side (in a direction denoted with an arrow E in FIG. 2). In this manner, the end face 22 functions as a restricting portion.

Figure 2:
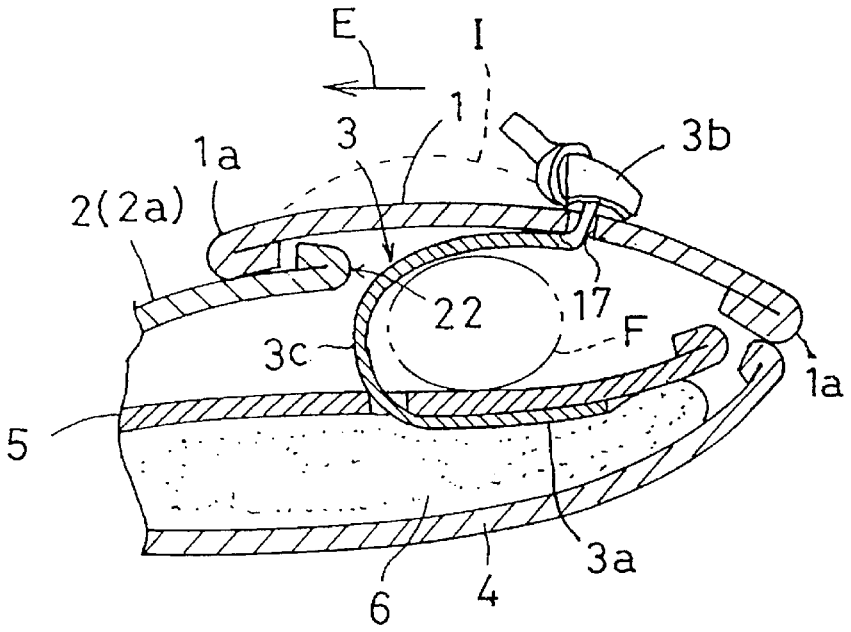
FIG. 2 is a section view taken along a line B—B in FIG. 1.
Figure 3:
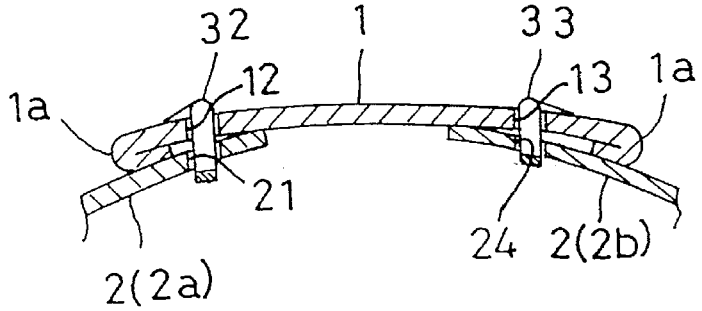
FIG. 3 is a section view taken along a line C—C in FIG. 1.

As shown in FIG. 2, a cushioning felt 6 is interposed between the inner ply 5 and the outer ply 4. As the thumb hook member 3 has movement thereof restricted as described above, the thumb F will be located at the core or center of the felt 6.

The first over 1 forms a reinforced portion 1*a* around an outer periphery thereof. This reinforced portion 1*a* is a double-layered construction formed by folding the leather member constituting the first cover member 1 at a peripheral edge thereof.

The belt portion 11 extends to a base end portion 11*a* of a little-finger inserting portion. And, this base end portion 11*a* defines holes 15, 16, into which laces 30, 31 are threaded for fixing the base portion 11 to e.g. the outer ply 4.

[other embodiments]

Other embodiments of the present invention will be described.

(1) In addition to the baseball glove described in the foregoing embodiment, the present invention is applicable also to a baseball mitt or any other kind of ball catching apparatus.

(2) In the foregoing embodiment, the second cover member 2 includes the left cover 2*a* and the right cover 2*b*. Instead, this second cover member 2 may be formed of a single cover.

(3) In the foregoing embodiment, the contour of the extension portion 10 of the first cover member 1 substantially corresponds to the contour of the second cover member 2. But, this is not essential in the present invention.

(4) The portion visible from the outside when the first cover member 1 and the second cover member 2 are assembled to each other may be eliminated. That is to say, the first cover member and the second cover member have substantially same contours at the position corresponding to the tip of the thumb.

(5) The connection between the first cover member 1 and the second cover member 2 may be effected by means of sewing with a thread, instead of the laces described in the foregoing embodiment.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A baseball glove comprising:

a body defining a hand-housing cavity and comprising a hand inserting portion and a thumb inserting portion, the hand-housing cavity having a ball-catching side and a non-ball-catching side, the thumb inserting portion comprising:

a palm portion provided on the ball-catching side of the cavity;

first and second cover members both provided on the non-ball-catching side of the cavity for together forming the thumb inserting portion, the first cover member including an extension portion extending along a direction of inserting the thumb, the second cover member being provided at least around the extension portion of the first cover member; and said thumb inserting portion is formed by the palm portion and the first and second cover members, by connecting the first and second cover members to each other at the extension portion such that the first cover member covers at least a portion of the second cover member.

2. A baseball glove as defined in claim 1, wherein connected portions of the first cover member and the second cover member are provided along an outer periphery of the extension portion.

3. A baseball glove as defined in claim 1, wherein the connection between the cover members is effected by means of a lace.

4. A baseball glove as defined in claim 3, wherein a plurality of holes for introducing the lace are defined along an outer periphery of the extension portion.

5. A baseball glove as defined in claim 1, wherein the connection between the cover members is effected by means of a thread.

6. A baseball glove as defined in claim 1, further comprising a little finger portion, a thumb hook member provided inside the thumb inserting portion and a restricting portion for restricting dislocation of the thumb hook member toward the little finger portion.

7. A baseball glove as defined in claim 6, wherein the second cover member defines a cutout extending along the inserting direction of the thumb, and an end face of the second cover member defines the restricting portion.

8. A baseball glove as defined in claim 7, wherein said thumb hook member includes a loop portion which is brought into contact with an end face of said second cover member.

9. A baseball glove as defined in claim 1, further comprising a hand inserting opening and a belt portion for forming the hand inserting opening, and the belt portion is formed integral with the first cover member.

* * * * *